US009457361B2

(12) United States Patent
Eley et al.

(10) Patent No.: US 9,457,361 B2
(45) Date of Patent: Oct. 4, 2016

(54) SPRAY NOZZLE ATTACHMENT AND METHODS THEREFOR

(75) Inventors: Craig D. Eley, Lincoln, NE (US); Darin Schollmeyer, Creighton, NE (US)

(73) Assignee: ELEY CORPORATION, Lincoln, NE (US)

( * ) Notice: Subject to any disclaimer, the term of this patent is extended or adjusted under 35 U.S.C. 154(b) by 947 days.

(21) Appl. No.: 13/294,277

(22) Filed: Nov. 11, 2011

(65) Prior Publication Data

US 2013/0119148 A1 May 16, 2013

(51) Int. Cl.

| | |
|---|---|
| ***B05B 1/30*** | (2006.01) |
| ***B05B 1/12*** | (2006.01) |
| ***B05B 1/04*** | (2006.01) |
| *B05B 1/26* | (2006.01) |

(52) U.S. Cl.

CPC ..... *B05B 1/12* (2013.01); *B05B 1/042* (2013.01); *B05B 1/30* (2013.01); *B05B 1/3033* (2013.01); *B05B 1/26* (2013.01)

(58) Field of Classification Search

CPC .... B05B 1/1663; B05B 15/066; B05B 1/323

USPC ..... 239/533.13, 519, 541, 546

See application file for complete search history.

(56) References Cited

U.S. PATENT DOCUMENTS

| | | | | |
|---|---|---|---|---|
| 186,310 | A * | 1/1877 | Curtis | B05B 1/185 239/546 |
| 351,968 | A * | 11/1886 | Derrick | B05B 1/185 239/546 |
| 3,775,470 | A * | 11/1973 | Tsuchiya | 562/8 |
| 3,776,470 | A * | 12/1973 | Tsuchiya | B05B 1/32 239/265.43 |
| 5,263,607 | A * | 11/1993 | Temesvary et al. | 221/304 |
| 7,240,857 | B1 * | 7/2007 | Stern | B05B 1/02 222/394 |

* cited by examiner

*Primary Examiner* — Len Tran
*Assistant Examiner* — Joel Zhou
(74) *Attorney, Agent, or Firm* — Perkins Coie LLP

(57) ABSTRACT

A spray nozzle comprising a fitting that includes a connector, an elongate cylindrical portion extending from the connector, and a bore formed longitudinally through the fitting. A flexible tube is disposed in the bore. The nozzle includes a sleeve that includes an inlet opening configured to slideably receive the cylindrical portion. The sleeve includes a converging outlet operative to selectively deform an end portion of the tube when the sleeve is urged longitudinally toward the connector.

12 Claims, 11 Drawing Sheets

SPRAY NOZZLE ATTACHMENT AND METHODS THEREFOR

BACKGROUND

Garden hose nozzles are many and varied; however, finding one that is specifically designed for cleaning is difficult. Most nozzles are either single function or multi-purpose having up to ten different patterns. This makes existing spray nozzles either too one dimensional or too complex to be easily used for cleaning tasks.

Accordingly, there is a need for an adjustable spray nozzle that is dependable, durable, and easy to operate. There is a further need for a spray nozzle that provides powerful functions required for cleaning tasks with the pressure and volume delivered by a garden hose.

SUMMARY

Provided herein is a spray nozzle comprising a fitting that includes a connector, an elongate cylindrical portion extending from the connector, and a bore formed longitudinally through the fitting. A flexible tube is disposed in the bore. The nozzle includes a sleeve that includes an inlet opening configured to slideably receive the cylindrical portion. The sleeve includes a converging outlet operative to selectively deform an end portion of the tube when the sleeve is urged longitudinally toward the connector.

The outlet includes at least one ramped surface to deform an end portion of the tube. In one case, the sleeve includes a pair of opposed ramped surfaces. In an embodiment, the converging outlet includes a pair of tapered walls. The tapered walls being operative to pinch the end portion of the tube.

The tube may extend beyond a distal end of the cylindrical portion. The sleeve may be rotatably disposed on the cylindrical portion such that the spray from the nozzle may be rotated relative to a hose. The nozzle may also include a cover disposed about the sleeve.

The connector is mateable with a hose and, in an embodiment, the connector includes threads mateable with a garden hose. In an embodiment, the tube includes a flange portion disposed in the connector to serve as a gasket between the spray nozzle and a hose.

In an embodiment, the cylindrical portion includes a retaining ring disposed on a distal end thereof. The sleeve includes a plurality of longitudinally spaced detent grooves adapted to receive the retaining ring. The end portion of the tube is deformed by an amount corresponding to the longitudinal position of each detent groove.

Also contemplated are methods of varying the spray from a nozzle. In an embodiment the method comprises supporting a flexible tube relative to a connector, directing a flow of fluid through the flexible tube, and urging at least one ramped surface against the flexible tube such that the tube is deformed. The method may further comprise retaining the ramped surface in a first position corresponding to a first deformation of the flexible tube. The method may also include moving the ramped surface to a second position corresponding to a second deformation of the flexible tube and retaining the ramped surface in the second position.

These and other aspects of the spray nozzle and methods therefor will be apparent after consideration of the Detailed Description and Figures herein.

DRAWINGS

Non-limiting and non-exhaustive embodiments of the spray nozzle, including the preferred embodiment, are described with reference to the following figures, wherein like reference numerals refer to like parts throughout the various views unless otherwise specified.

Figure 1:
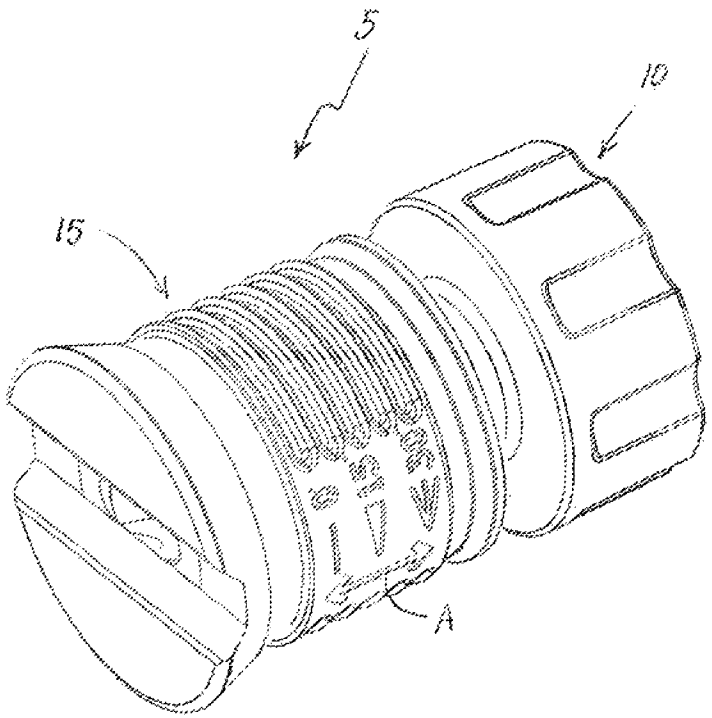
FIG. 1 is a perspective view of a spray nozzle according to an exemplary embodiment.
Figure 2:
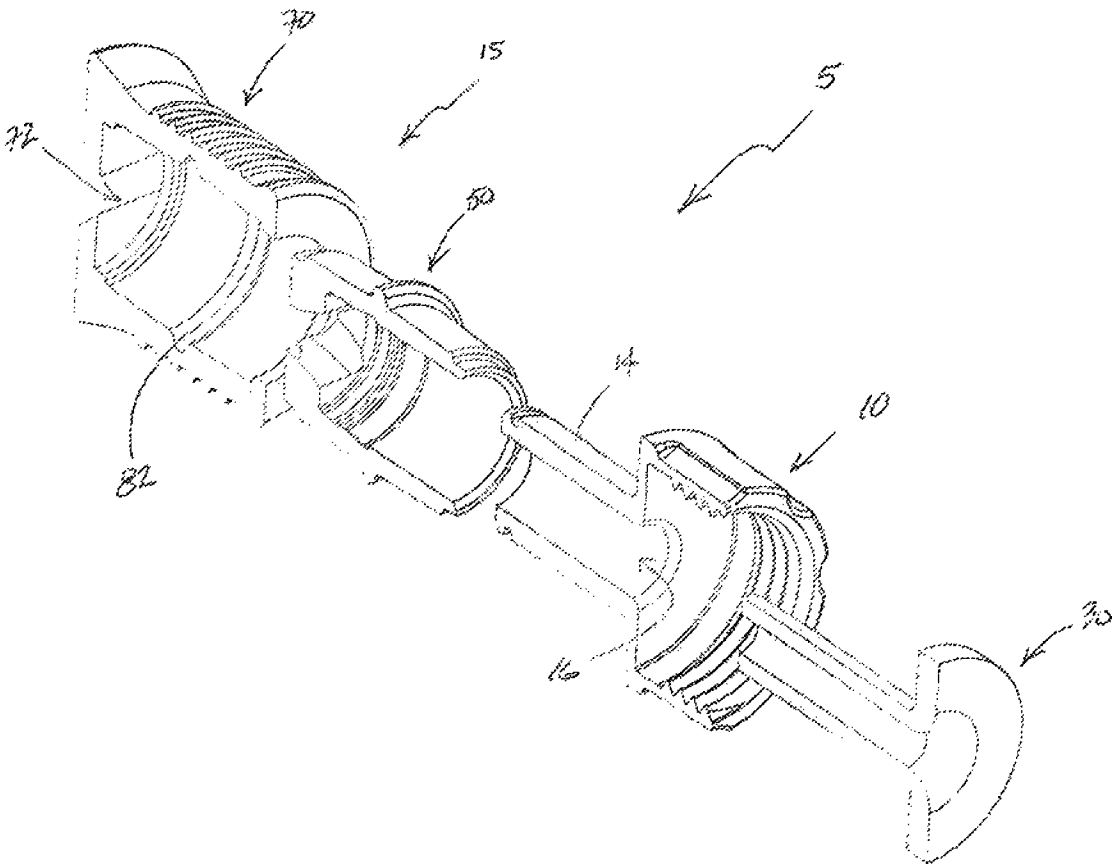
FIG. 2 is an exploded cross-sectional view of the spray nozzle shown in FIG. 1.
Figure 3A:
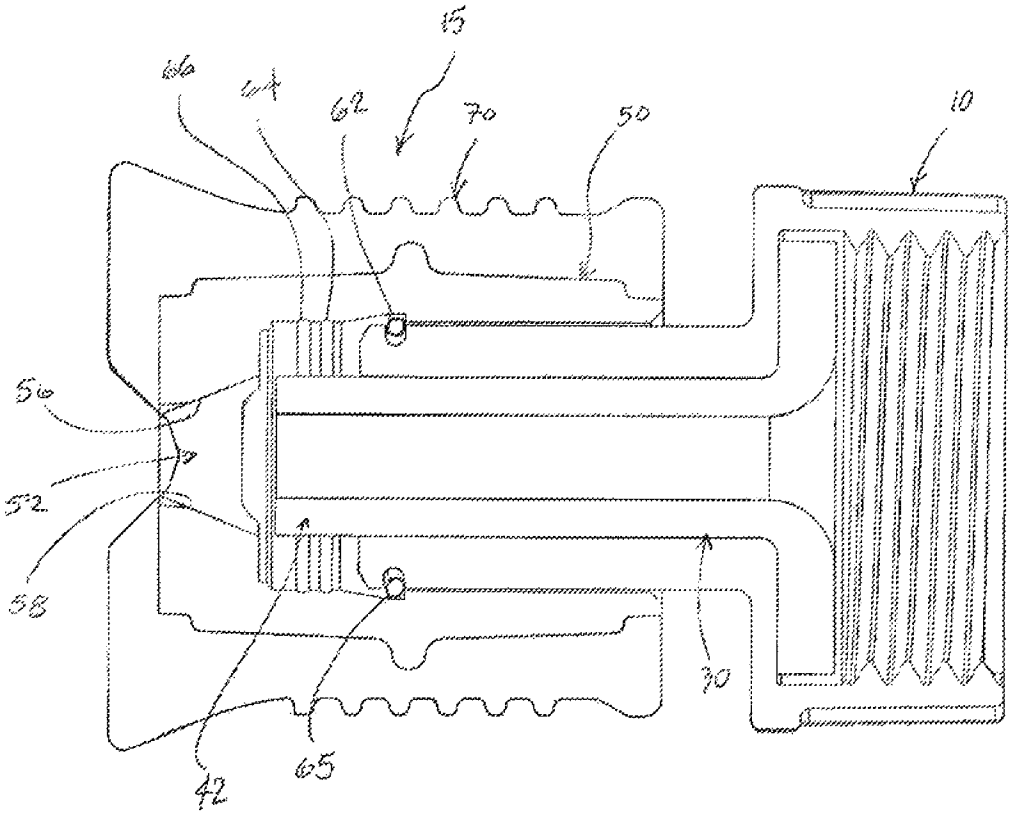
Figure 3B:
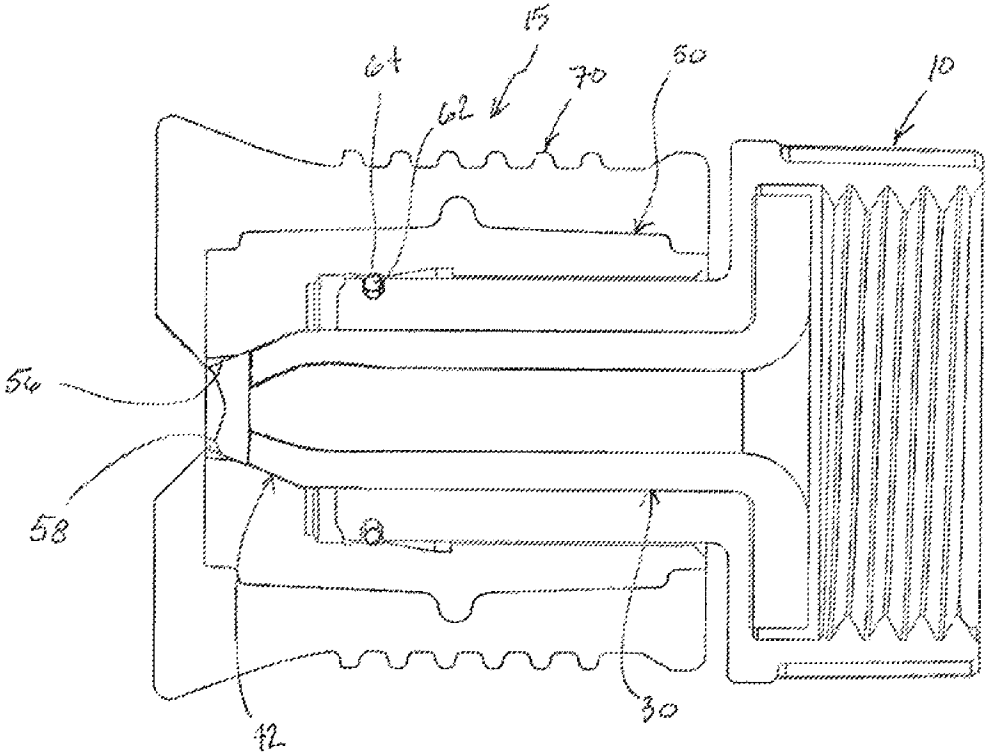
Figure 3C:
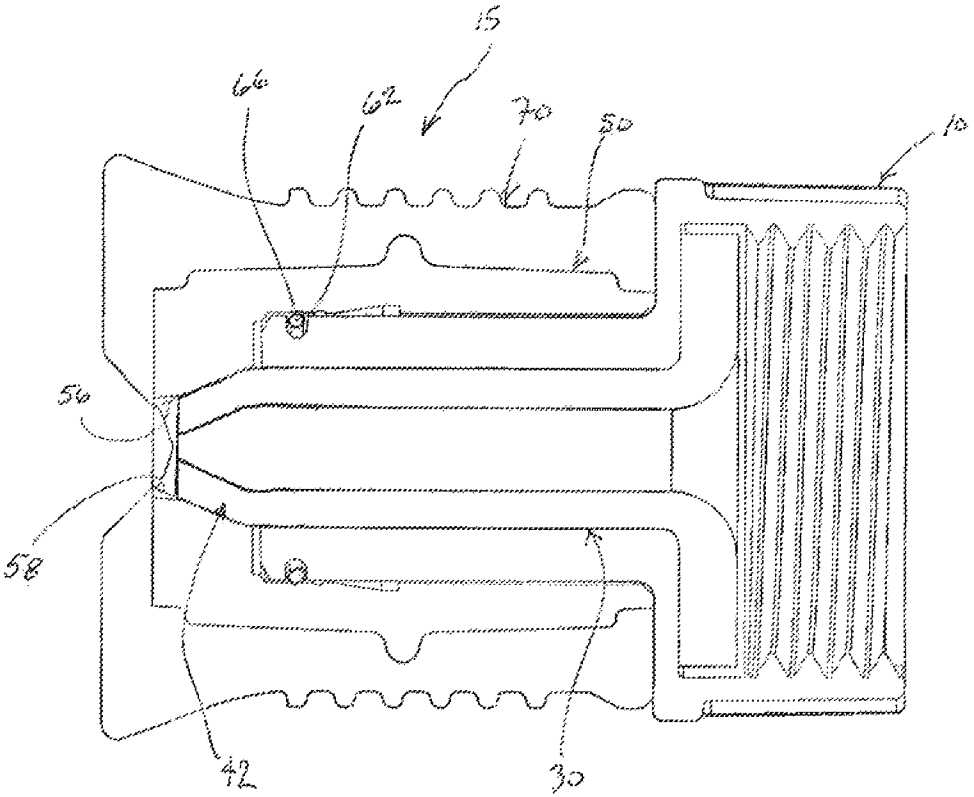
Figure 4:
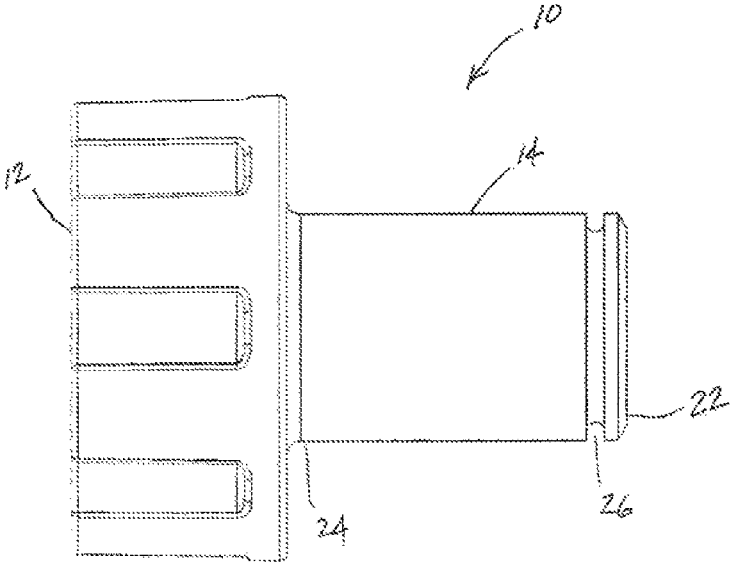
Figure 5:
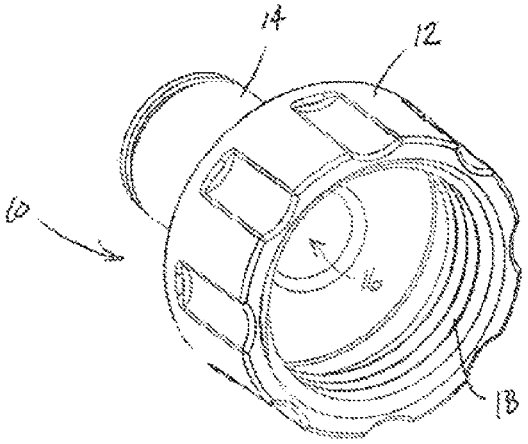
Figure 6:
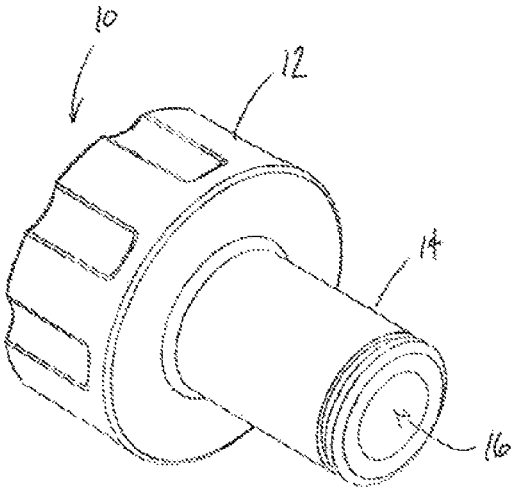
Figure 7:
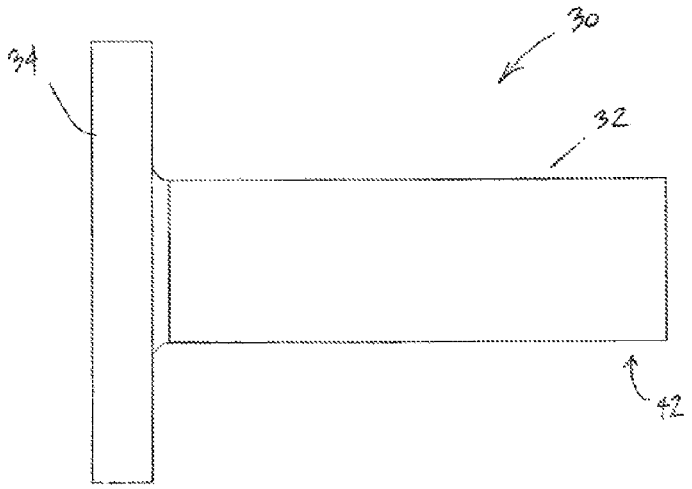
Figure 9:
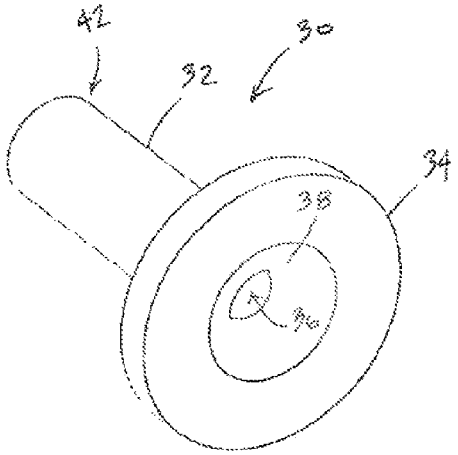
Figure 8:
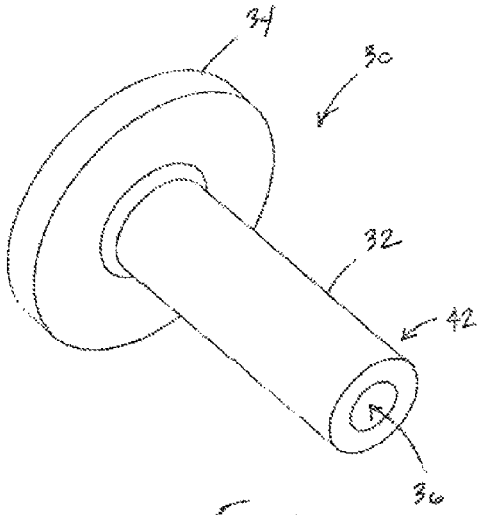
Figure 12:
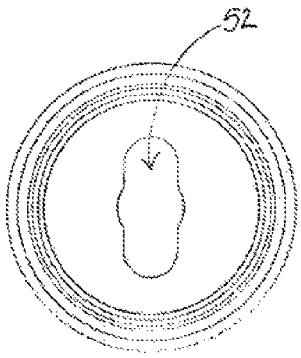
Figure 10:
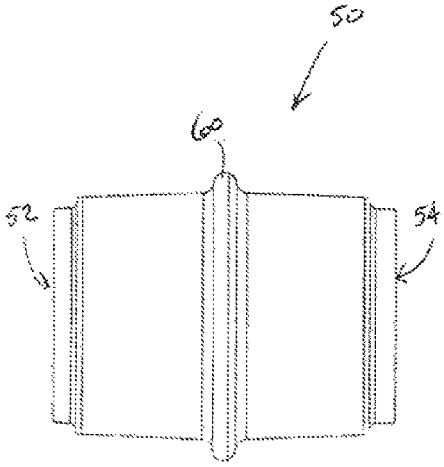
Figure 11:
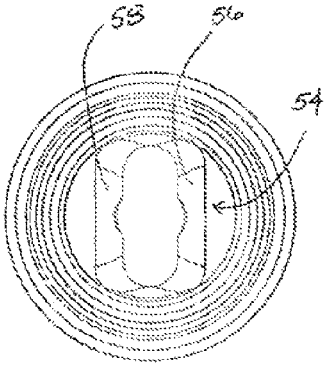
Figure 13:
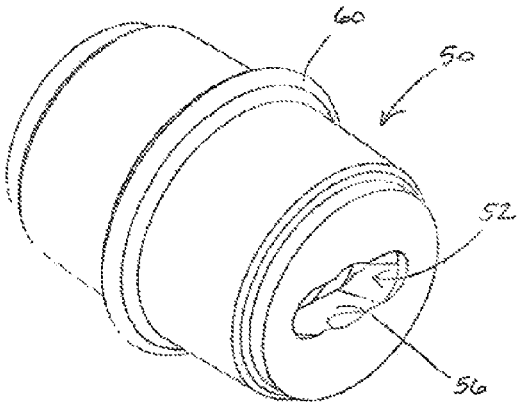
Figure 14:
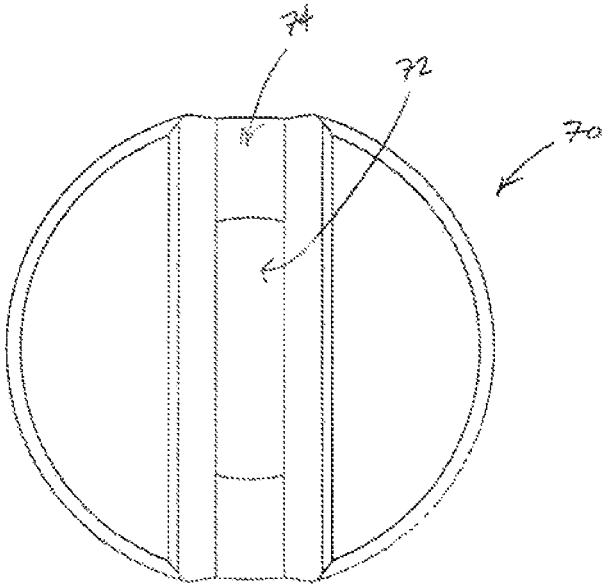
Figure 15:
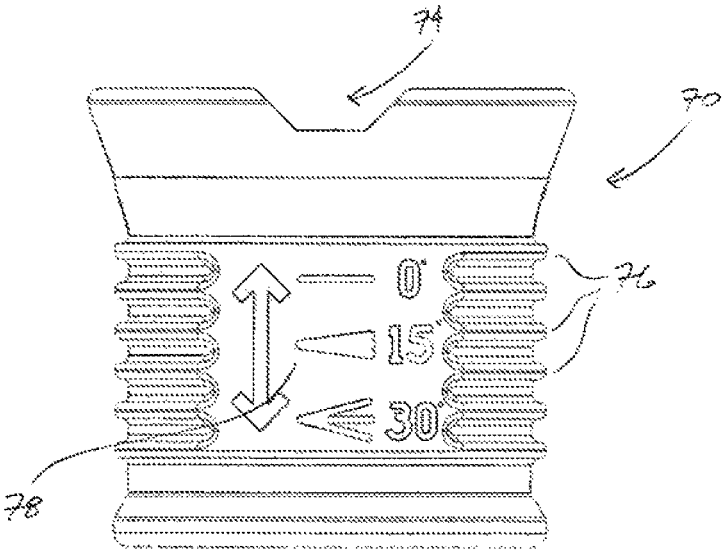
Figure 16:
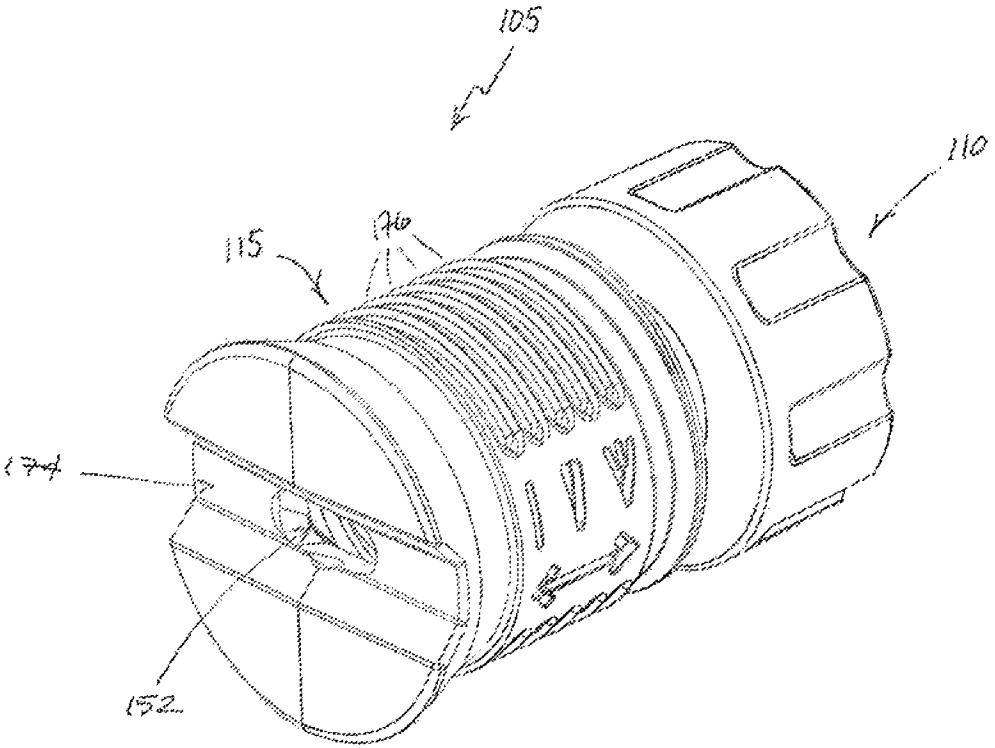
Figure 17:
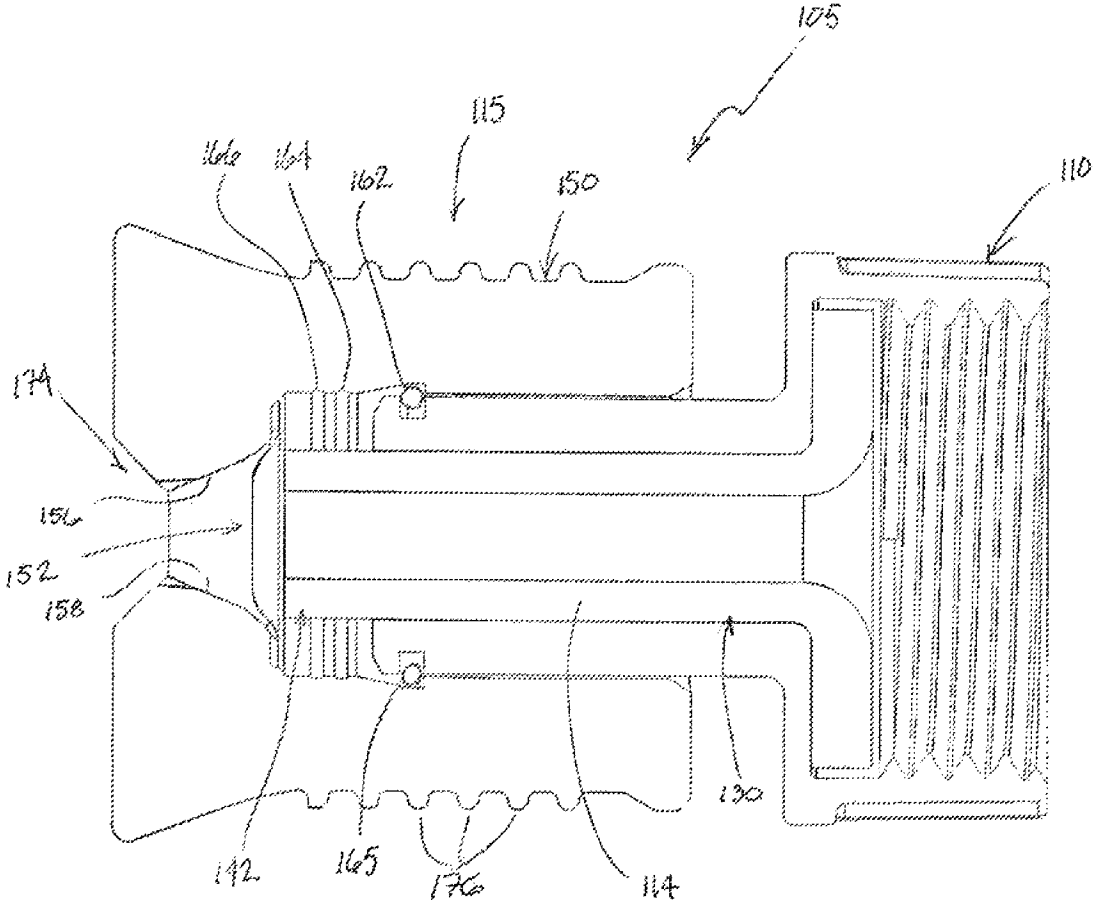

FIG. 3*a* is a cross-sectional side view in elevation of the spray nozzle shown in FIGS. 1 and 2 in a first spray position;

FIG. 3*b* is a cross-sectional side view in elevation of the spray nozzle shown in FIGS. 1 and 2 in a second spray position;

FIG. 3*c* is a cross-sectional side view in elevation of the spray nozzle shown in FIGS. 1 and 2 in a third spray position;

FIG. 4 is a side view in elevation of the spray nozzle fitting;

FIG. 5 is a perspective view of the nozzle fitting shown in FIG. 4 as viewed from the connector end;

FIG. 6 is a perspective view of the fitting shown in FIGS. 4 and 5 as viewed from the cylindrical portion;

FIG. 7 is a side view in elevation of the flexible tube;

FIG. 8 is a perspective view of the flexible tube shown in FIG. 7;

FIG. 9 is a perspective view of the flexible tube shown in FIGS. 7 and 8 as viewed from the flange end;

FIG. 10 is a side view in elevation of the adjustor sleeve;

FIG. 11 is an end view of the adjustor sleeve shown in FIG. 10 showing the inlet of the sleeve;

FIG. 12 is an end view showing the outlet of the adjustor sleeve shown in FIG. 10;

FIG. 13 is a perspective view of the adjustor sleeve shown in FIGS. 10-12 as viewed from the outlet end;

FIG. 14 is the spray adjustor cover as shown in FIG. 1;

FIG. 15 is a side view in elevation of the adjustor cover;

FIG. 16 is a perspective view of a spray nozzle according to a second exemplary embodiment; and FIG. 17 is a cross-sectional side view in elevation of the spray nozzle shown in FIG. 16.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Spray nozzle 5, shown in FIG. 1, includes a fitting 10 for attachment to a hose, such as a garden hose, and a spray adjustor 15. Spray adjustor 15 may be adjusted longitudinally in the direction of arrow "A" from an unrestricted stream when in the fully extended state to a fan spray when the adjustor sleeve 15 is urged toward fitting 10. The spray adjustor 15 is shown in FIG. 1 in a fully extended state. The spray adjustor 15 may be urged toward fitting 10 in increments as indicated by arrow "A". In this case, spray adjustor 15 has three positions. The extended position (0 degrees), delivers a direct jet stream of water to give the greatest impact on a surface. The first retracted step (15 degrees), delivers a 15 degree fan for cleaning with a wider cut path and the second retracted step (30 degrees) produces a wider 30 degree fan for rinsing larger areas quickly. Spray adjustor 15 may also be rotated about the longitudinal axis of the spray nozzle. While the spray adjustor is shown here as having three positions, it should be appreciated that the adjustor could have more or fewer positions.

As shown in FIG. 2, the spray nozzle 5 is comprised of several components including fitting 10. Fitting 10 includes a bore 16 that is configured to receive flexible tube 30. Fitting 10 also includes an elongate cylindrical portion 14 which supports the spray adjustor 15. Spray adjustor 15 includes an adjustment sleeve 50 which is encased by cover 70. With further reference to FIGS. 3*a*-3*c*, the adjustment of the spray nozzle may be appreciated. In FIG. 3*a*, the adjustment sleeve 50 is retained on the elongate cylindrical portion 14 of fitting 10 by a retaining ring 62. Retaining ring 62 is disposed in a retaining ring groove 26 formed around a distal end portion 22 of fitting 10. Retaining ring 62 confronts retaining groove 65 formed around the interior of adjustment sleeve 50 thereby capturing the adjustment sleeve 50 on the cylindrical portion of fitting 10. In FIG. 3*a*, the spray adjustor 15 is in its fully extended position in which there is no deformation of flexible tube 30. However, as can be appreciated with reference to FIG. 3*b*, once the spray adjustor 15 is urged toward fitting 10, the end portion 42 of flexible tube 30 is deformed as it confronts the converging outlet comprised of side walls 56 and 58 at the end of adjustment sleeve 50. The adjustment sleeve 50 is retained in this position when retaining ring 62 engages detent groove 64. The longitudinal position of detent groove 64 corresponds to a particular amount of deformation of end portion 42, which in this case, corresponds to the first retracted step of approximately a 15-degree spray angle. In FIG. 3*c*, the spray adjustor 15 has been urged to its furthest extent toward fitting 10 such that the end portion 42 of flexible tube 30 is deformed by the converging outlet. In this case, the end portion 42 is deformed such that a spray angle of approximately 30 degrees is achieved corresponding to the second retracted step. The spray adjustor 15 is retained in this position when retaining ring 62 engages the detent groove 66.

With reference to FIG. 4, fitting 10 includes a connector portion 12 from which extends an elongate cylindrical portion 14. Elongate cylindrical portion 14 includes a proximate end 24 nearest the connector portion 12 and extends to terminate in a distal end 22. Proximate to distal end 22 is the retaining ring groove 26, which receives the retaining ring 62. With further reference to FIGS. 5 and 6, fitting 10 includes a bore 16 formed longitudinally through the fitting. In this case, the connector portion 12 includes threads which are mateable with a garden hose, for example.

The flexible tube 30, as shown in FIG. 7, includes a tube portion 32 which is connected to a flange 34. Flange 34, when installed, is disposed in the connector portion 12 of fitting 10. Thus, flange 34 acts as a gasket between the fitting 10 and a supply hose, such as a garden hose. The tube portion 32 of flexible tube 30 has an end portion 42 which extends beyond the distal end 22 of fitting 10. Also, as shown in the figures, the flexible tube includes a passage 36 extending therethrough. Passage 36 is deformed when urged against the converging outlet of the adjusting sleeve 50. With reference to FIG. 9, there is a radiused transition 38 between flange 34 and passage 36. Radiused transition 38 helps to reduce restriction and facilitates fluid flow into the flexible tube 30.

FIGS. 10-13 illustrate the construction of the adjustment sleeve 50. Adjustment sleeve 50 includes an inlet 54 connected to an outlet 52. Inlet 54 is sized to receive the elongate cylindrical portion 14 of fitting 10. Outlet 52 includes a converging region comprised of a pair of tapered side walls 56 and 58. Side walls 56 and 58 are in opposed relation such that the resulting outlet 52 is an elongate slot. Accordingly, as end portion 42 of flexible tube 30 is urged toward the converging outlet, the opposed side walls 56 and 58 deform the end portion 42 such that a fan-shaped spray is created. While the converging outlet is comprised of tapered sidewalls 56 and 58 in this case, other ramped surfaces may be employed to create the fan shaped spray or other shaped spray patterns. As explained above with reference to FIGS. 2-3*c*, adjustment sleeve 50 also includes a plurality of longitudinally spaced-apart detent grooves 64 and 66. Adjustment sleeve 50 also includes a retaining groove 65 which prevents the adjustment sleeve 50 from being removed from fitting 10. It can be appreciated that the grooved retaining arrangement allows the adjustment sleeve 50 to be rotated about the elongate cylindrical portion 14 of fitting 10 such that the fan spray may be oriented as desired. Adjustment sleeve 50 also includes a rib 60 which engages a corresponding groove 82 formed in cover 70 (see FIG. 2).

As shown in FIG. 14, the spray adjustor cover 70 includes an outlet 72 which aligns with outlet 52 of the adjustor sleeve 50. Accordingly, outlet 72 is configured as a slot. The slot is disposed in a channel region 74 which provides a divergence through which the spray flows. As shown in FIG. 15, the spray adjustor cover 70 includes a plurality of ribs 76 which provide grip for adjusting the spray adjustor 15. Also, the spray adjustor cover 70 includes indicia 78 that corresponds to the angle of the spray fan for each longitudinal position of the spray adjustor.

The spray nozzle 5 may be comprised of various materials as one of ordinary skill in the art can appreciate. For example, the fitting 10 may be comprised of metal such as brass, aluminum, or steel. Alternatively, fitting 10 may be comprised of molded plastic such as ABS. Flexible tube 30 should, of course, be comprised of a flexible material such as rubber such that the flange portion acts as a gasket and the tube portion 32 is deformable when urged against the converging outlet region. Adjustment sleeve 50 may be comprised of brass, aluminum, or steel such as in the case of the fitting. Also, adjustment sleeve 50 may be comprised of plastic such as ABS. The spray adjustor cover 70 may be comprised of a suitable material which may be either molded onto adjustment sleeve 50 or forcibly installed over rib 60 on adjustment sleeve 50. Accordingly, spray adjustor cover 70 may be comprised of a hard rubber or other suitably flexible material. The components described herein may be molded or machined, for example.

FIG. 16 illustrates a spray nozzle 105 according to a second exemplary embodiment. Spray nozzle 105 includes a fitting 110 for attachment to a hose, such as a garden hose, and a spray adjustor 115. With further reference to FIG. 17, spray nozzle 105 is similar to the embodiment described above with respect to FIGS. 1-15. However, in this embodiment, the spray adjustor 115 comprises adjustment sleeve 150 and does not include a separate cover. Instead the adjustment sleeve 150 is a unitary body that includes a channel region 174 and a plurality of ribs 176 which provide grip for adjusting the spray adjustor 115. While adjustment sleeve 50 may be comprised of brass, aluminum, or steel, it may be preferable to form the adjusting sleeve 50 from plastic, such as ABS.

As in the previous embodiment, the adjustment sleeve 150 is retained on the elongate cylindrical portion 114 of fitting 110 by a retaining ring 162. Retaining ring 162 is disposed in a retaining ring groove 126. Retaining ring 162 confronts retaining groove 165 formed around the interior of adjustment sleeve 150 thereby capturing the adjustment sleeve 150 on the cylindrical portion of fitting 110. The adjustment sleeve 150 may be moved along the cylindrical portion 114 in order to vary the spray pattern by deforming end portion 142 of flexible tube 130 as it confronts the converging outlet 152 comprised of side walls 156 and 158. The adjustment sleeve 150 is retained in position along cylindrical portion 114 when retaining ring 162 engages the detent grooves 164, 166.

Also contemplated herein are methods of varying the spray from a nozzle. The methods thus encompass the steps inherent in the above described structures and operation thereof. Broadly, one method may include supporting a flexible tube relative to a connector, directing a flow of fluid through the flexible tube, and urging at least one ramped surface against the flexible tube such that the tube is deformed. The method may also include retaining the ramped surface in a first position corresponding to a first deformation of the flexible tube and subsequently moving the ramped surface to a second position corresponding to a second deformation of the flexible tube and retaining the ramped surface in the second position.

Although the technology and methods of using and/or applying the same have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A spray nozzle, comprising:

a fitting including a connector attachable to a hose, an elongate cylindrical portion extending therefrom, and a bore formed longitudinally through the fitting; the cylindrical portion including a retaining ring disposed on a distal end thereof;

a flexible tube disposed in the bore; and a sleeve including an inlet opening configured to slidably receive the cylindrical portion, and a converging outlet operative to selectively deform an end portion of the tube when the sleeve is urged longitudinally toward the connector; the sleeve including a plurality of longitudinally spaced detent grooves adapted to receive the retaining ring;

the sleeve being slidably moveable, longitudinally, along the cylindrical portion between at least first and second spray positions, wherein the end portion of the tube is deformed by an amount corresponding to the longitudinal position of each detent groove.

2. The spray nozzle of claim 1, wherein the converging outlet includes a pair of tapered walls.

3. The spray nozzle of claim 2, wherein the tapered walls are operative to pinch the end portion of the tube.

4. The spray nozzle of claim 1, further comprising a cover disposed about the sleeve.

5. The spray nozzle of claim 1, wherein the connector includes threads mateable with a garden hose.

6. The spray nozzle of claim 1, wherein the tube extends beyond a distal end of the cylindrical portion.

7. The spray nozzle of claim 1, wherein the tube includes a flange portion disposed in the connector.

8. The spray nozzle of claim 1, wherein the sleeve is rotatably disposed on the cylindrical portion.

9. A spray nozzle, comprising:

a fitting including a connector attachable to a hose, an elongate cylindrical portion extending therefrom, and a bore formed longitudinally through the fitting;

a flexible tube disposed in the bore, wherein the tube extends beyond a distal end of the cylindrical portion and the tube includes a flange portion disposed in the connector, whereby the flange is positioned to seal against a distal end portion of the hose, when the hose is attached with the connector; wherein the cylindrical portion includes a retaining ring disposed on the distal end; and a sleeve including an inlet opening configured to slidably receive the cylindrical portion, and an outlet including a pair of opposed, planar surfaces that are fixed in a converging position with one another, whereby defining the outlet as an elongate slot and operative to selectively deform an open end portion of the tube into an elongate slot when the sleeve is urged longitudinally toward the connector; wherein the outlet defined by the pair of opposed, planar surfaces, is shaped to prevent the open end portion of the tube from passing through the outlet, whereby a fluid pathway of the spray nozzle exits from the open end portion of the tube, then through the outlet of the sleeve.

10. A spray nozzle, comprising:

a fitting including a connector attachable to a hose, an elongate cylindrical portion extending therefrom, a retaining ring disposed on a distal end of the cylindrical portion, and a bore formed longitudinally through the fitting;

a flexible tube disposed in the bore, wherein the tube extends beyond a distal end of the cylindrical portion and the tube includes a flange portion disposed in the connector, whereby the flange is positioned to seal against a distal end portion of the hose, when the hose is attached with the connector; and a sleeve including an inlet opening configured to slidably receive the cylindrical portion, and an outlet including a pair of ramped surfaces operative to selectively deform an end portion of the tube when the sleeve is urged longitudinally toward the connector; the sleeve further including a plurality of longitudinally spaced detent grooves adapted to receive the retaining ring.

11. The spray nozzle of claim 10, wherein the end portion of the tube is deformed by an amount corresponding to the longitudinal position of each detent groove.

12. The spray nozzle of claim 9, wherein the sleeve is rotatably disposed on the cylindrical portion.

* * * * *